US006533607B2

(12) United States Patent
Jochen et al.

(10) Patent No.: US 6,533,607 B2
(45) **Date of Patent: *Mar. 18, 2003**

(54) MULTI-CONDUCTOR CABLE CONNECTOR WITH INTEGRAL GROUNDING BUS

(75) Inventors: Art Jochen, Norco, CA (US); Roger D. Lang, Foothill Ranch, CA (US); John A. C. McAllister, Lake Forest, CA (US)

(73) Assignee: Circuit Assembly Corp., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/872,168

(22) Filed: Jun. 1, 2001

(65) Prior Publication Data

US 2002/0004332 A1 Jan. 10, 2002

Related U.S. Application Data

(63) Continuation of application No. 09/562,802, filed on May 2, 2000, now Pat. No. 6,280,242, which is a continuation of application No. 09/243,153, filed on Feb. 2, 1999, now Pat. No. 6,077,105, which is a continuation of application No. 08/813,543, filed on Mar. 7, 1997, now Pat. No. 5,902,147.

(51) Int. Cl.[7] ..... H01R 12/24
(52) U.S. Cl. ..... 439/497; 439/405
(58) Field of Search ..... 439/497, 405, 439/404, 417, 402

(56) References Cited

U.S. PATENT DOCUMENTS

| | | | | |
|---|---|---|---|---|
| 4,027,941 A | * | 6/1977 | Narozny | 439/402 |
| 4,068,912 A | | 1/1978 | Hudson, Jr. et al. | |
| 4,094,564 A | | 6/1978 | Cacolici | |
| 4,095,862 A | | 6/1978 | Hatch | |
| 4,194,803 A | | 3/1980 | Hatch | |
| 4,260,209 A | | 4/1981 | Zell et al. | |
| 4,270,831 A | | 6/1981 | Takahashi | |
| 4,493,007 A | | 1/1985 | Sugitani | |
| 4,596,428 A | | 6/1986 | Tengler | |
| 4,601,527 A | | 7/1986 | Lemke | |
| 4,641,904 A | | 2/1987 | Kosugi et al. | |
| 4,681,382 A | | 7/1987 | Lockand | |
| 4,701,139 A | | 10/1987 | Good et al. | |
| 4,747,787 A | | 5/1988 | Siwinski | |
| 4,762,500 A | | 8/1988 | Dola et al. | |
| 4,781,620 A | | 11/1988 | Tengler | |
| 4,824,384 A | | 4/1989 | Nicholas et al. | |
| 4,892,489 A | | 1/1990 | Hirai | |
| 4,902,243 A | | 2/1990 | Davis | |
| 4,938,711 A | | 7/1990 | Davis et al. | |
| 5,041,011 A | | 8/1991 | Chiang | |
| 5,060,372 A | | 10/1991 | Capp et al. | |
| 5,104,336 A | | 4/1992 | Hatanaka et al. | |
| 5,161,987 A | | 11/1992 | Sinisi | |
| 5,338,221 A | | 8/1994 | Bowen et al. | |
| 5,536,179 A | | 7/1996 | Olsson et al. | |

* cited by examiner

*Primary Examiner*—Tho D. Ta
(74) *Attorney, Agent, or Firm*—Knobbe, Martens, Olson & Bear, LLP

(57) ABSTRACT

A connector for connecting to ribbon cable corresponding to the SFF-8049 specification. The connector includes a plurality of ground contacts having an insulation displacement end that are positioned within a retainer plate so that the insulation displacement end of the ground contacts pierce the insulation surrounding every other conductor of the ribbon cable which comprise the grounded conductors forming the ground bus. Signal contacts having an insulation displacement end and a mating end are positioned within a body of the connector so that the insulation displacement end can be positioned through the retainer plate in an orientation where they will be able to engage with signal conductors within the ribbon cable. The plurality of ground contacts are configured to have tabs to engage with selected signal contacts so that grounded signal conductors within the ribbon cable can be connected to the ground bus in the connector. The signal contact further includes a mating end which is positioned within an opening in the base of the connector that is suitable for receiving the pins of a mating connector or pin array.

15 Claims, 7 Drawing Sheets

MULTI-CONDUCTOR CABLE CONNECTOR WITH INTEGRAL GROUNDING BUS

This is a continuation application of U.S. Application No. 09/562,802, filed May 2, 2000, now U.S. Pat. No. 6,280,242, issued Aug. 28, 2001, which was a continuation application of U.S. Application No. 09/243,153, filed Feb. 2, 1999, now U.S. Pat. No. 6,077,105, issued Jun. 20, 2000, which was a continuation of U.S. Application No. 08/813,543 filed Mar. 7, 1997 now U.S. Pat. No. 5,902,147, issued May 11, 1999.

BACKGROUND OF THE INVENTION

1. Field of the Invention

The present invention relates to connectors configured to connect to multiconductor ribbon cable and, in particular, concerns a connector that is configured to connect to both signal conductors and ground conductors defining a ground bus in the multi-conductor cable.

2. Description of the Related Art

Ribbon cable is a type of cable which has a plurality of conductors positioned adjacent each other in a single plane. Typically, the conductors are encased in a flexible insulating material, such as vinyl, which follows the contours of the parallel closely spaced conductors in the ribbon cable. Ribbon cable is often used to interconnect computer components. One common example of the use of ribbon cable is to connect motherboards in personal computers to disk drives. Further, ribbon cable is also often used to interconnect computers to accessory equipment.

Generally, connectors are used to interconnect the cables to various devices. These connectors have a plurality of contacts which are configured to contact the conductors within the ribbon cable and also to provide a pin connection to a matching connector or pin array. Typically, the connectors include a plurality of contacts that have an insulation displacement end that pierces the insulation surrounding the conductor in the ribbon cable and contacts the embedded conductor, and a mating end that provides a connection point for pins of a mating connector or pin array.

The typical connector is generally rectangular in shape and has an opening which receives the ribbon cable so that the connector spans the width of the ribbon cable. The insulation displacement ends of the plurality of contacts are positioned within the connector so that when the connector is closed around the ribbon cable, the insulation displacement ends pierce the insulation surrounding the conductors of the ribbon cable and form an electrical connection with each of the conductors within the ribbon cable. It will be appreciated that the contacts are exactly positioned within the connector so as to be able to contact and make an electrical connection with the corresponding conductor within the ribbon cable.

One typical ribbon cable assembly application used in the prior art has forty conductors that are spaced on 0.050" centers. Of the forty conductors within the cable, seven of these conductors are dedicated as ground conductors and the remaining thirty-three are data line or signal conductors. This type of ribbon cable complies with ANSIx3.279-1996 specification. The structure of the prior art ribbon cables results in these ribbon cables having an upward limit of approximately 16 MB/Sec. data transfer rate over the ribbon cable.

As computers have become increasingly more powerful, there has been a desire to increase the rate of data transmission over ribbon cables. This has resulted in the creation of a new ribbon cable specification, the SFF-8049 specification. Ribbon cables corresponding to the SFF-8049 specification will now have eighty conductors that are spaced apart on 0.025" centers. Hence, the ribbon cable under the new specification will have the same general size, otherwise known as form factor, as the ribbon cable of the prior art. The ribbon cable of the new specification retains the forty original signal conductors, the 33 data conductors and the 7 ground conductors, of the prior art ribbon cable. This permits use of the new specification cable in the place of the old specification ribbon cable without requiring the alteration of the input and output devices that are connected to the ribbon cable.

However, the forty additional conductors that are added to the ribbon cable of the new specification are all ground conductors that are positioned between each of the original forty conductors. Consequently, the original signal conductors are separated from each other by a dedicated ground conductor in the new specification cable. Hence, the forty additional ground conductors form a ground bus which results in the new specification ribbon cable being able to transmit data at a significantly higher rate than the old specification ribbon cable.

However, the introduction of the new specification ribbon cable has complicated the task of connecting devices to the new specification ribbon cable. In particular, the forty conductors forming the ground bus must be grounded to each termination of the ribbon cable and at any mid-length connection to the ribbon cable for the ground bus to function most effectively. Presently, to achieve this connection, a first prior art connector that was originally configured to attach to the forty original conductors is slightly modified so that the contacts will selectively engage with the forty original signal conductors in the new specification cable when mounted on the ribbon cable. A second connector, similar in construction to the first connector, that is configured to attach to the forty alternating ground conductors that comprise the ground bus is then mounted on the ribbon cable.

While the use of the two connectors results in adequate connection to the forty original signal conductors and the forty added ground conductors, using two connectors is more costly and also increases the possibility of poor connection to the conductors within the ribbon cable. Further, the use of two connectors at each termination or mid-length connection to the ribbon cable complicates the use of the ribbon cable particularly in environments where the space surrounding the ribbon cable is limited.

Moreover, it is desirable to attach the seven original grounded signal conductors to the ground bus at each connector. Presently, this is accomplished by stringing jumpers between the pin connections of the seven ground conductors on the first connector to the ground contacts on the second connector. However, this sort of interconnection complicates the installation of the connectors to the new specification ribbon cable as this must typically be done by hand after the cable has been installed. Hence, there is a need for a connector that can be connected to the new specification ribbon cable which will connect to both the forty original signal conductors and also to the forty ground bus conductors. This connector should preferably have a form factor that is substantially the same as the form factor of the connectors used in the prior art. Further, this connector should also be configured so that interconnection between the forty ground conductors and the seven original signal ground conductors is simplified.

SUMMARY OF THE INVENTION

The aforementioned needs are satisfied by the connector of the present invention which comprises a first member having a receiving surface that is configured to receive a ribbon cable and a base member that engages with the first member so as to position a first surface of the base member adjacent the receiving surface of the first member. The base member has a plurality of receptacles or openings that are configured to receive contacts wherein the plurality of receptacles are positioned within the base member. Specifically, the connector is configured so that a first plurality of contacts can be positioned within the receptacles so as to make electrical contact with a first group of conductors within the ribbon cable and a second plurality of receptacles that are configured to receive a second plurality of contacts so that the second plurality of contacts can make electrical contact with a second group of conductors within the ribbon cable.

The first plurality of contacts are configured to make electrical contact with the first group of electrical conductors within the ribbon cable that, collectively, comprise a ground bus. Preferably, the first plurality of ground contacts are electrically interconnected so as to maintain the integrity of the ground bus. Further, the second plurality of contacts are configured to make electrical contact with the second group of electrical conductors within the ribbon cable that are signal conductors within the ribbon cable. Preferably, the second plurality of contacts include pin connections that permit external connection to the signal conductors within the ribbon cable via the connector.

In one embodiment, the connector incorporates signal contacts which have an insulation displacement end and a mating end. The insulation displacement end is configured to displace the insulation of the ribbon cable and make contact with the wire embedded therein. The mating end is configured to make a resilient pin contact for connection to a mating connector or pin array. The contacts are positioned within the body of the connector so that the mating end of the contacts are positioned within openings in the body so as to allow access to the mating connector or pin array. The insulation displacement end is preferably comprised of two blades with a gap therebetween. The two blades are preferably sized and configured to displace the insulation surrounding an embedded conductor within the ribbon cable so that the embedded conductor will be positioned between the two blades and thereby make electrical contact.

In one aspect of the present invention, the connector is configured to be used in conjunction with ribbon cable which incorporates a plurality of signal conductors and a plurality of ground conductors. The ground conductors forming a ground bus are preferably positioned between each of the signal conductors in the ribbon cable. The connector is arranged so that there are a plurality of rows of contacts wherein a first row is positioned within the connector so that when the ribbon cable is positioned within the cable receiving area of the connectors, the first row of contacts is connected to alternating conductors of the ribbon cable which comprise the ground conductors. The second row of contacts are positioned within the connectors so that the second row of contacts are connected to signal conductors within the ribbon cable. A third row of contacts may also be added to make contact to additional signal conductors.

In one embodiment, the connector is configured to be used with SFF-8049 ribbon cable which has forty signal conductors and forty ground conductors positioned within the cable. The connector of the preferred embodiment has three or more rows of contacts that are arranged in the first direction across the width of the cable receiving area. The center row of contacts is positioned so as to be connected to each of the forty conductors comprising the ground bus. In particular, the contacts are positioned within the connector so that when the connector is attached to the ribbon cable, the contacts make electrical contact with alternating conductors within the ribbon cable that form the ground bus. The two outer rows of contacts of the connector of the preferred embodiment are each configured to connect to twenty of the remaining forty signal wires within the ribbon cable.

In another aspect of the present invention, the connector is configured to include a first plurality of contacts that connect to signal conductors within the ribbon cable and a second plurality of contacts that connect to ground conductors within the ribbon cable, and the connector is configured so that contacts connected to the ground bus, that are adjacent to signal conductors that are grounded signal conductors, can be interconnected in the connector. In the preferred embodiment, the contacts that are connected to the ground conductors include tabs that can be bent so as to make an electrical connection with contacts that are connected to grounded signal conductors.

From the foregoing, it will be appreciated that the connector of the preferred embodiment includes contacts that are mounted within a base that preferably has a form factor similar to prior art connectors, and the connector is configured to be able to be attached to both signal conductors and ground conductors within a ribbon cable. The use of a single connector simplifies the process of connecting ribbon cable to additional devices. Further, the interconnection between the ground bus and grounded signal conductors within the ribbon cable is simplified by the use of ground bus contacts within the connector that can be readily connected to adjacent signal conductor contacts. These and other objects and advantages of the present invention will become more fully apparent from the following description taken in conjunction with the accompanying drawings.

DETAILED DESCRIPTION OF THE PREFERRED EMBODIMENT

Figure 1:
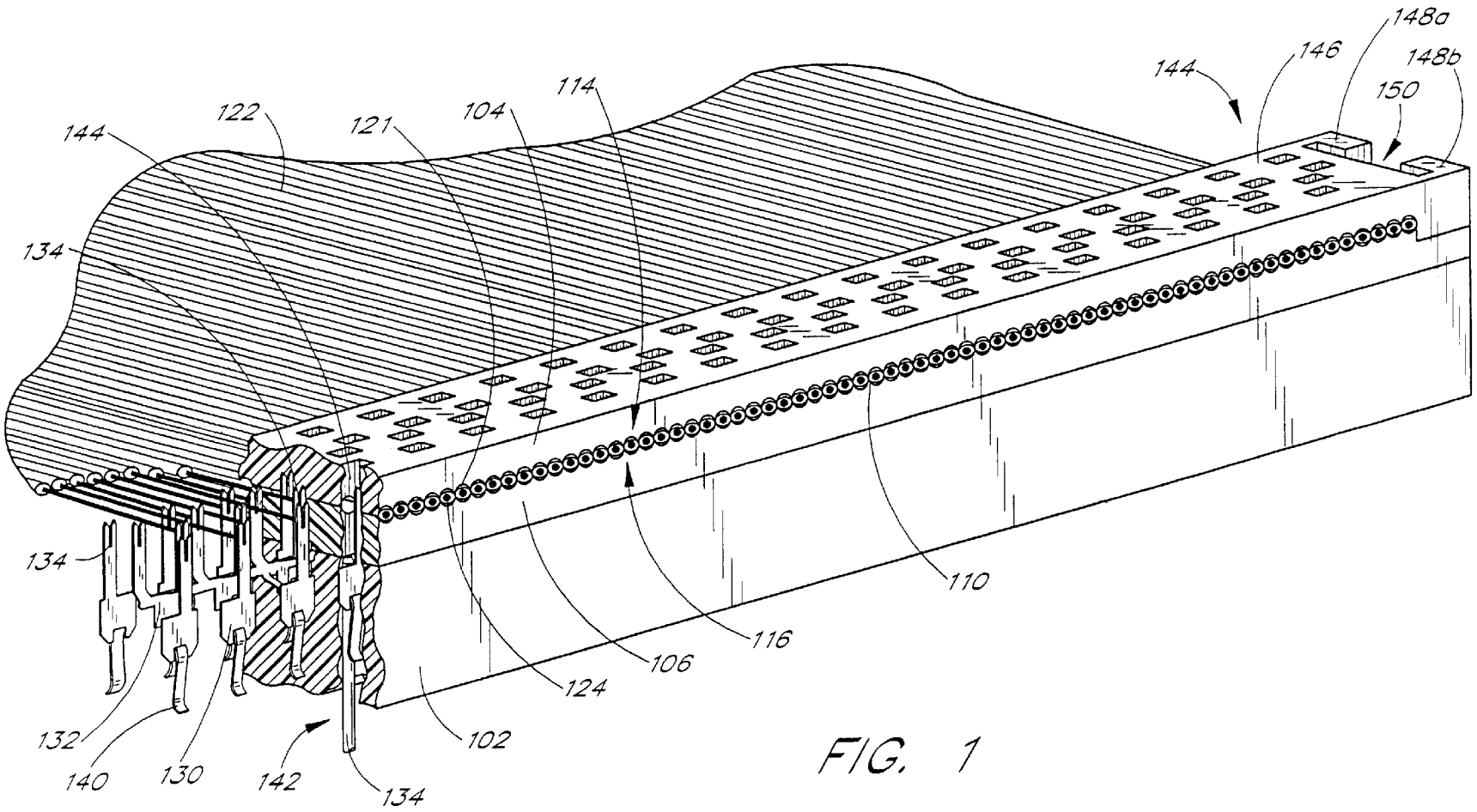
FIG. 1 is a partially cut away perspective view of a connector of the preferred embodiment.

Reference will now be made to the drawings wherein like numerals refer to like parts throughout. Referring initially to FIG. 1, the connector 100 incorporates a base 102 that is attached to a cover 104, in a manner that will be described hereinbelow, and a retainer 106 that is interposed between the base 102 and the cover 104. The cover 104 includes an inner surface 110 that has a plurality of indentations 112 that are configured to receive ridges 121 of insulation surrounding each individual conductor 124 within the ribbon cable 122. Similarly, the retainer 106 also includes an inner surface 114 that has a plurality of indentations 116 that are also configured to receive the ridges 121 of the insulation surrounding the individual conductors of the ribbon cable 122. Collectively, the inner surface 110 of the cover 104 and the inner surface 114 of the retainer 106 define a receiving area 120 for the ribbon cable 122.

As will be described in greater detail below, the ribbon cable 122 is positioned within the receiving area 120 and the indentations 112 and 116 are configured to urge the ribbon cable 122 into a fixed orientation with respect to the inner surface 110 of the cover 104 and the inner surface 114 of the retainer 106. Specifically, the indentations 112 and 116 are configured so as to center each conductor 124 within a space 126 between the indentations 112 and 116. Consequently, when the ribbon cable 122 is captured between the cover 104 and the retainer 106, each of the conductors within the ribbon cable is fixed in a precise location with respect to the cover 104 and the retainer 106.

The typical ribbon cable has a plurality of conductors or wires 124 that are arranged so as to be spaced parallel from each other and surrounded by insulation. The insulation is typically a vinyl insulation which is contoured around each conductor 124, thereby forming the ridges 121 shown in FIG. 1. The insulation further provides electrical insulation between each of the conductors. In the preferred embodiment, the connector 100 is configured to receive ribbon cable which corresponds to the SFF-8049 specification, i.e., ribbon cable which incorporates eighty conductors that are spaced on approximately 0.025" centers.

As is also shown in the partial cut away section of FIG. 1, a plurality of signal contacts 130 and a plurality of ground contacts 132 are mounted within the base 102 in an orientation so that the contacts 130, 132 make electrical contact with the conductors 124 in the ribbon cable 122. In this embodiment, there are four parallel rows of contacts 130, 132 extending across the entire length of the connector and thereby spanning the full width of the ribbon cable 122 that is positioned in the cable receiving area 120. Specifically, there are two rows of signal contacts 130*a* and 130*b* with two rows of ground contacts 132*a* and 132*b* interposed therebetween. As will be described in greater detail below, the two rows of ground contacts 132*a*, 132*b* in the preferred embodiment share a common mounting section and are therefore electrically connected together.

As the connector 100 in the preferred embodiment is configured to be used in conjunction with ribbon cable corresponding to the SFF-8049 specification, the ground contacts 132 are configured to make electrical connection with the conductors 124 within the ribbon cable 122 that are the ground conductors. In particular, in the ribbon cable 122, the ground conductors forming the ground bus are spaced so that every other conductor within the ribbon cable 122 is a ground conductor. As the conductors 124 of the ribbon cable 122 are spaced on 0.025" centers, the ground contacts 132 are mounted in the connector 100 so as to be 0.050" apart from each other so as to extend into every other space 126 that is defined by the indentations 112 and 116 on the inner surface of the cover 110 and the inner surface of the retainer 114, respectively.

The signal contacts 130 are arranged into two rows of twenty each. Each of these signal contacts 130 is mounted within the base 102 so as to extend into every fourth space 126 defined by the indentations 112 and 116 on the inner surface of the cover and retainer 110 and 114, respectively. The rows of signal contacts 130 are preferably spaced so that every other signal conductor within the ribbon cable 122 is contacted by each row of signal contacts 130*a* and 130*b*.

FIG. 1 also illustrates the basic configuration of the signal contacts 130 and the ground contacts 132. The configuration of these contacts will be described in greater detail below, however, FIG. 1 illustrates that both the signal contacts 130 and the ground contacts 132 have an insulation displacement end 134. The insulation displacement end 134 is essentially comprised of two blades 136. The two blades 136 are configured to displace, in a well known manner, the insulation surrounding the conductor 124 in the ribbon cable so that the inner surfaces of the two blades 136 make contact with the conductor 124 that is captured in this space 126 in the manner that is shown in FIG. 1. Further, the signal contacts 130 include a mating end 140 which extends into the base 102 of the connector 100 and is configured to be connected to a pin on an external mating connector or pin array. Specifically, as shown in FIG. 1, the mating end 140 is exposed via an opening 142 so that pins or pin contact members can be positioned within the opening 142 to make electrical contact with the signal contacts 130. FIG. 1 further illustrates that the ground contacts 132 are connected to each other so as to form a single body with a plurality of insulation displacement ends 134 extending outward therefrom. The exact configuration of the signal contacts 130 and the ground contacts 132 will be described in greater detail hereinbelow.

Figure 2:
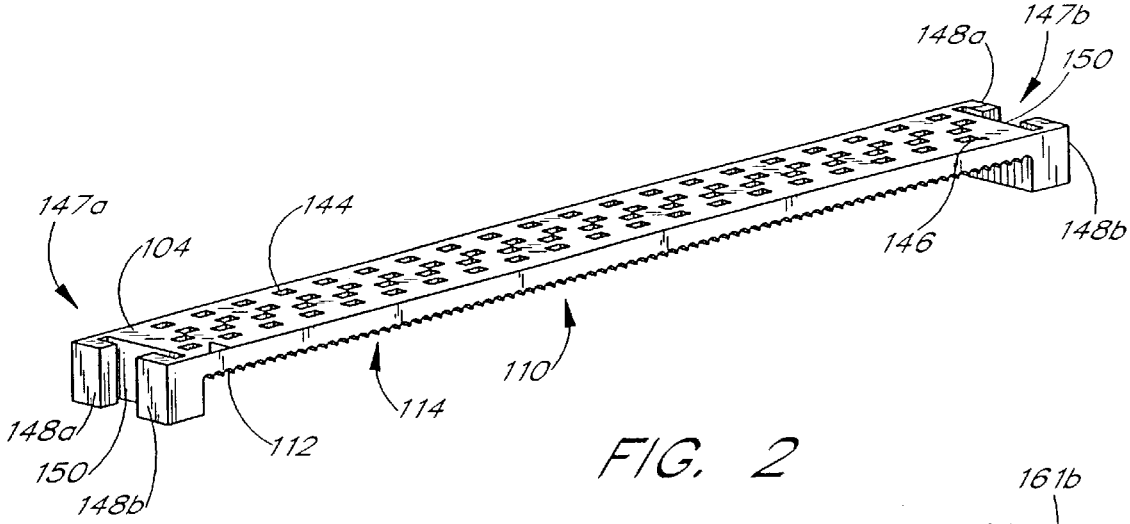
FIG. 2 is a perspective view of a bottom plate of the connector of FIG. 1.

FIG. 2 illustrates the cover member 104 in greater detail. In particular, the cover member 104 is preferably a molded plastic member that is approximately 2.18 inches long by 0.240 inches wide. As shown in FIG. 1, the ribbon cable 122 is positioned along the length of the cover member 104 so that the conductors 124 within the ribbon cable are preferably centered within the indentations 114 on the inner surface 110 of the cover 104. As is shown in FIG. 2, a plurality of openings 144 are preferably formed through the cover member 104. The openings 144 are spaced so as to receive the blades 136 of the insulation displacement ends 134 of both the signal contacts 130 and the ground contacts 132. Specifically, after the blades 136 have penetrated through the insulation surrounding the conductors 124 within the ribbon cable 122, the blades 136 preferably extend into the openings 144 in the manner shown in FIG. 1. Hence, the openings 144 preferably capture the blades 136 in a space defined by the opening 144 so that the blades 136 on adjacent contacts cannot be bent during insertion of the contacts or manipulation of the connector to contact adjacent signal contacts 130 or ground contacts 132.

Consequently, as shown in FIG. 2, there are two rows of openings 144 positioned towards the outer edges of the cover 104 that are configured to receive the blades 136 of the insulation displacement end 134 of the signal contacts 130. Similarly, there are two closely spaced rows of openings 144 in the cover member 104 that are configured to receive the blades 136 of the ground contacts 132. As is shown in FIG. 2, the openings 144 that are configured to receive the blades 136 of the ground contacts 132 are slightly offset from each other to accommodate the configuration of the ground contacts 132. The exact configuration of the ground contacts 132 will be described in greater detail below in reference to FIGS. 5A and 5B.

At both ends 147*a* and 147*b* of the cover 104, there are two blocks 148*a* and 148*b* which extend outward from a base member 146 of the cover member 104. The two blocks 148*a* and 148*b* define an opening 150 that extends through the width of the cover 104 and is used to secure the cover 104 to the retainer 106 and the base member 102 in a manner that will be described in greater detail below.

Figure 3A:
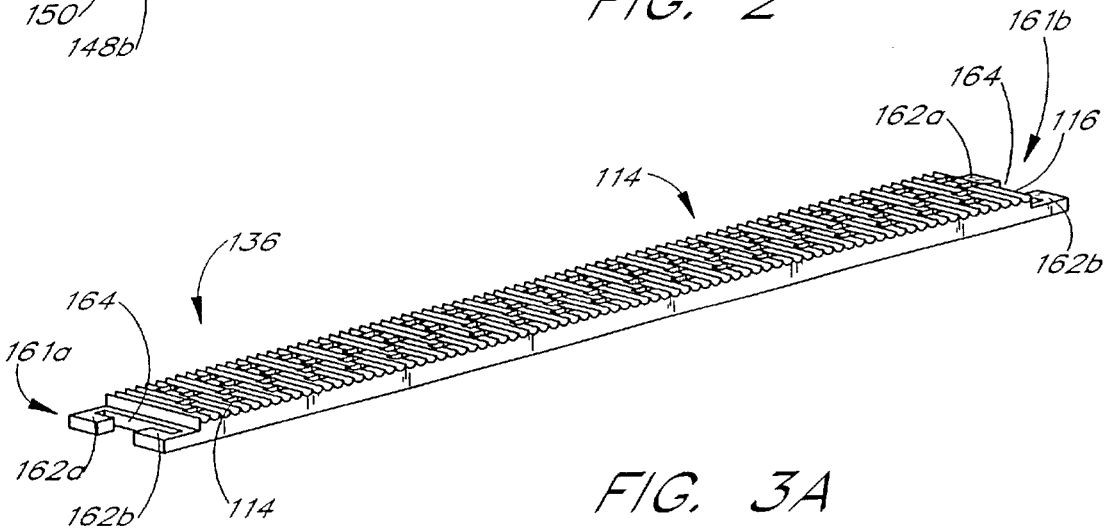
FIG. 3A is a top perspective view of a retainer that is used in the connector of FIG. 1.
Figure 3B:
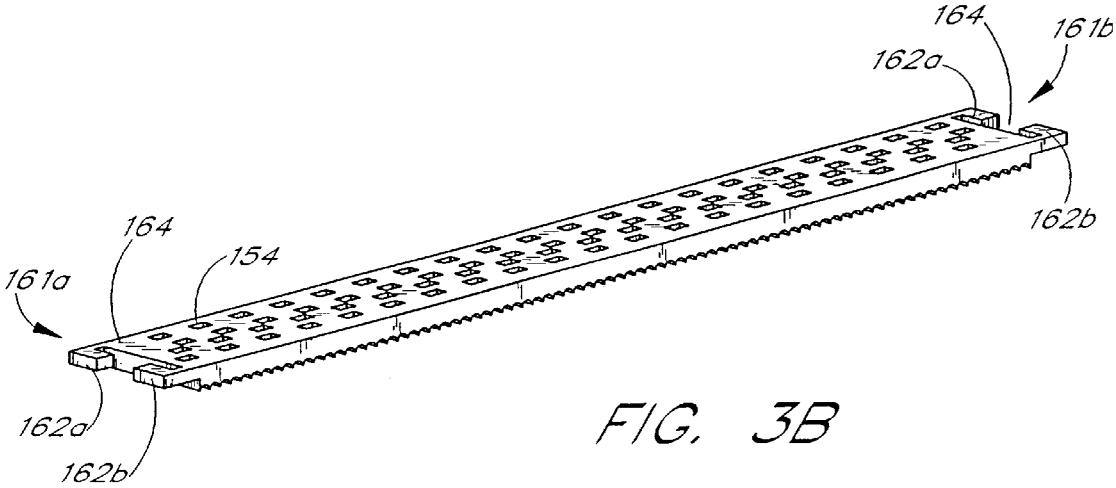
FIG. 3B is a bottom perspective view of the retainer of FIG. 3A.

FIG. 3A and FIG. 3B illustrate the retainer 106 in greater detail. The retainer 106 of the preferred embodiment has dimensions of approximately 2.18 inches long by 0.240 inches wide and is also preferably made of molded plastic. FIG. 3A illustrates the inner surface 114 of the retainer 106 with the indentations 116. Specifically, there are eighty indentations 116 formed on the inner surface 114 of the retainer 106. The retainer is dimensioned so as to sit adjacent the inner surface 110 of the cover 104 in the manner shown in FIG. 1. As is also shown in FIGS. 3A and 3B, there is a plurality of openings 154 extending through the retainer 106 so that each indentation 116 has a single opening 154 formed therein. The openings 154 in the retainer 106 have the same pattern as the openings 144 in the cover member 104. Specifically, the openings 154 are configured to receive the insulation displacement ends 134 of the signal contacts 130 and the ground contacts 132 and to guide the insulation ends 134 into the appropriate space 126 to thereby make an electrical connection to the appropriate conductor 124 in the ribbon cable 122.

The function of the retainer 106 is to ensure that the insulation displacement ends 134 of the contacts 130 and 132 are retained in their desired orientation such that the blades 136 are positioned in the spaces 126 defined by the indentations 112 and 116 of the cover 104 and retainer 106, respectively, in the manner shown in FIG. 1. It will be appreciated that forcing the blades 136 through the insulation so as to contact each of the eighty conductors within the ribbon cable 122 requires that there be a significant amount of force exerted between the base 102 and the cover 104. This force can result in the contacts 130 being bent so that the insulation displacement ends 134 of the contacts 130 and 132 would not necessarily make electrical contact with the conductors in the spaces 126. However, the retainer 106 is configured to guide the blades 136 into the appropriate conductor 124.

Specifically, the openings 154 in the retainer are preferably sized so that a neck portion 156 (FIG. 1) of the insulation displacement end 134 of both the signal contacts 130 and the ground contacts 132 is captured within the openings 154 in the retainer 106. The neck portion 156 of the insulation displacement end 134 of the contacts 130 and 132 extend from a base or mounting section to the blades 136 of the contacts 130 and 132. When the contacts 130 and 132 are mounted in the connector 100, the neck portion 156 of each contact is positioned within the opening 154 in the retainer 106 so that only the blade portion 136 extends into the spaces 126 containing the conductors 124. Hence, the retainer 106 ensures that the blades 136 are appropriately positioned within the spaces 126 so as to be able to displace the insulation ridges 121 and make electrical contact with the conductors 124 in the ribbon cable 122 that is captured within the cable receiving area 120 of the connector 100.

As is also shown in FIGS. 3A and 3B, two blades 162*a* and 162*b* extend outward from the ends 161*a* and 161*b* of the retainer 106 so as to define a generally T-shaped opening 164. The T-shaped opening 164 preferably mates with the T-shaped opening 150 on the cover 104 so that the cover 104 and the retainer 106 can be secured together in the manner described in greater detail below.

Figure 4:
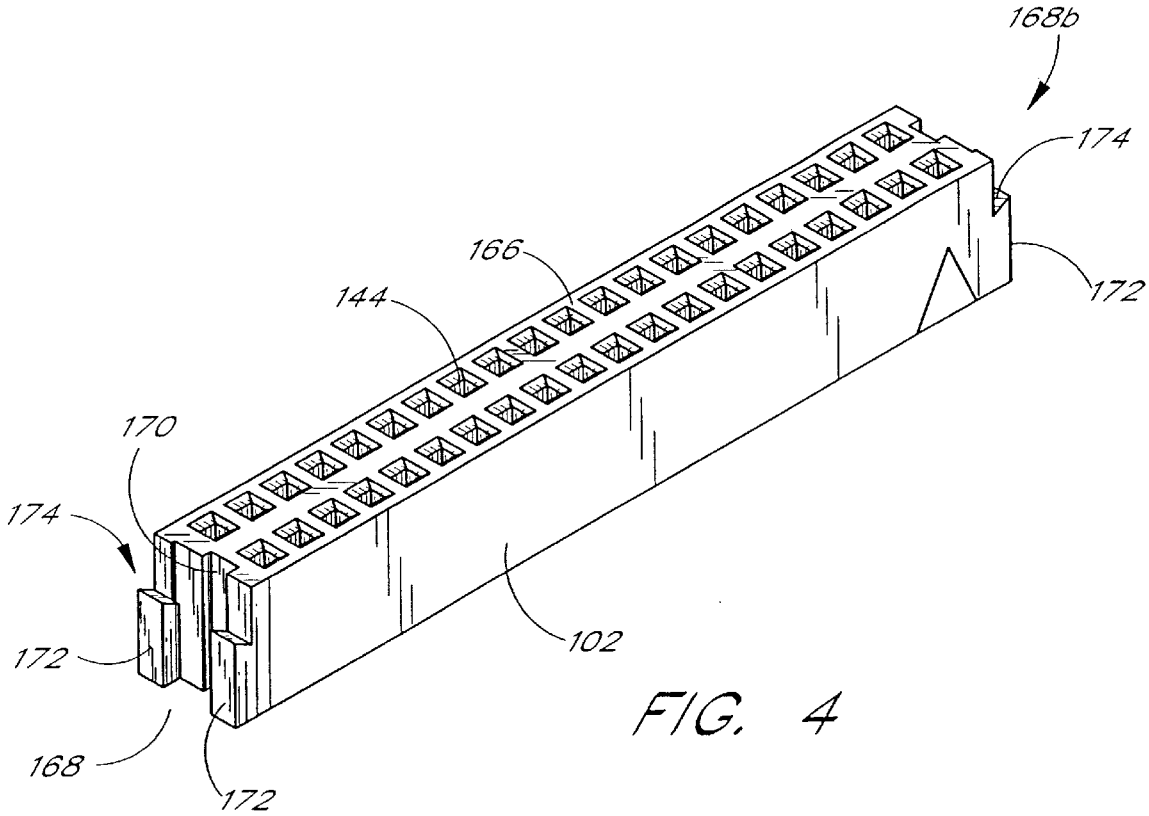
FIG. 4 is a perspective view of a base member of the connector of FIG. 1.
Figure 7:
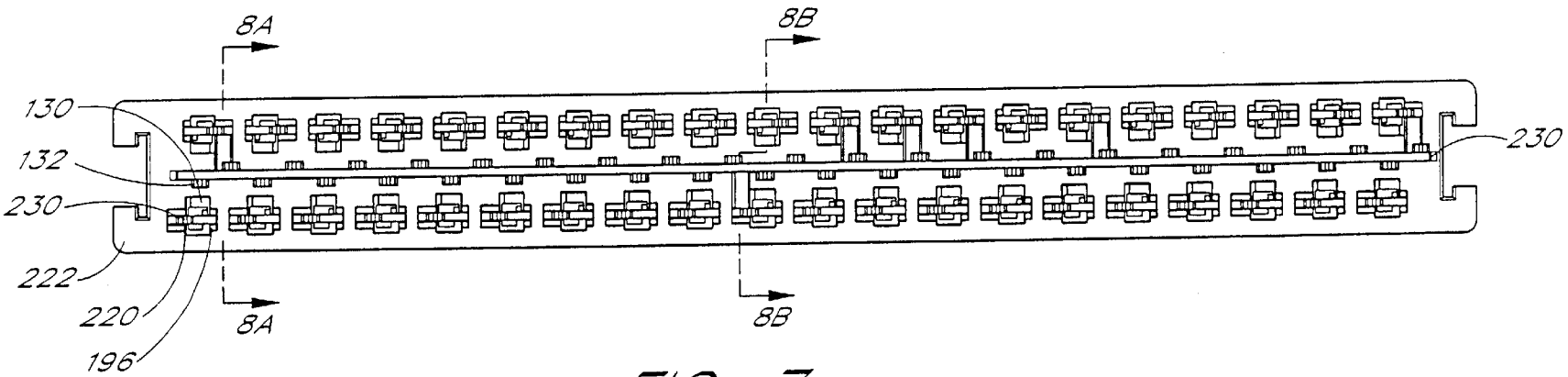
FIG. 7 is a bottom perspective view of the base member of the connector of FIG. 1 illustrating the location of the ground conductor contacts and the signal conductor contacts.

The base 102 of the connector 100 is illustrated in FIGS. 4 and 7. Specifically referring to FIG. 4, an outer surface 166 of the base 102 of the connector 100 is shown. The openings 142 are formed in two parallel lines along the outer surface of the base 102. The openings 142 in this embodiment are generally rectangular in shape and are configured to receive pins or contacts from mating connectors or pin arrays to thereby permit electrical connection to the signal conductors of the ribbon cable 122 via the signal contacts 130. Specifically, the mating ends 140 of the signal contacts 130 extend upward into the openings 142 and the openings 142 are preferably configured to receive pin contacts from mating connectors, mating pin arrays, or any other device that is used to interconnect to ribbon cable connectors. As shown in FIG. 4, there are two rows of twenty openings that provide access to the mating ends 140 of the forty signal contacts 130. It will be appreciated, however, that the exact configuration of the openings 142 will vary depending upon the implementation of the connector.

As is also shown in FIG. 4, both ends 168*a* and 168*b* of the base member 102 of the connector 100 include a coupling groove 170 and two outwardly extending members 172*a* and 172*b* that are positioned adjacent the sides of the base member 102. The upper surface 174 of the outwardly extending members 172 are both angled upward with respect to the ends 168*a* and 168*b* of the base member 102. The coupling grooves 170 and the members 172 are used to secure the base member 102 with the retainer 106 and the cover section 104. The engagement between the components mounted on the ends 168 of the base member and the components mounted on the ends of the cover 104 and the retainer 106 will be described in greater detail below.

Figure 5A:
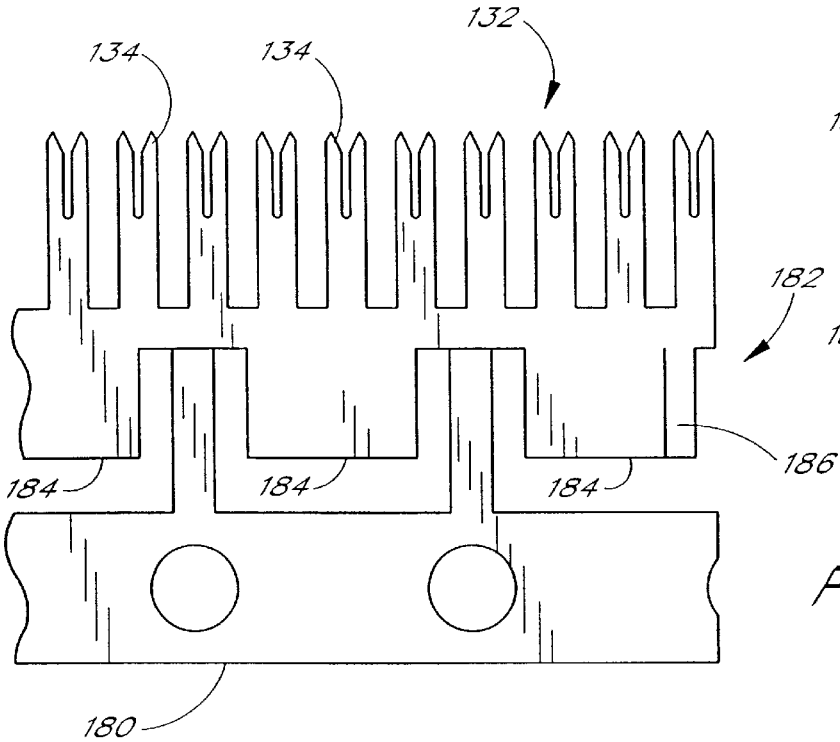
FIGS. 5A and 5B are isometric illustrations of the ground bus contacts of the connector of FIG. 1.
Figure 5B:
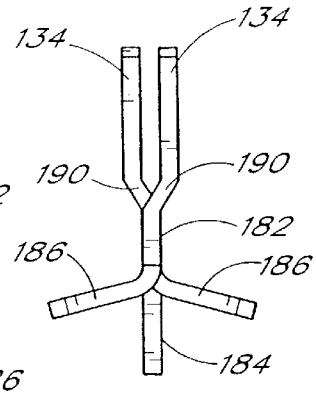

FIGS. 5A and 5B illustrate the preferred configuration of the ground contacts 132 in greater detail. In particular, the ground contact 132 is preferably comprised of a single connected strip of ground contacts 132 that are initially positioned on one or more carriers 180. The carriers 180 allow for handling of the plurality of ground contacts 132 without touching the insulation displacement ends 134 and thereby inducing the insulation displacement ends 134 to move relative to each other. It is understood that the insulation displacement ends 134 must be exactly positioned and exactly oriented prior to insertion of the ground contacts 132 into the base 102 of the connector 100. This is necessary to ensure that the insulation displacement ends 134 are appropriately oriented to be inserted into the appropriate conductors 124 of the ribbon cable 122 when the connector 100 is fully assembled in the manner illustrated in FIG. 1.

As is also shown in FIG. 5A, the plurality of ground contacts 132 are essentially comprised of a mounting section 182 and a plurality of insulation displacement ends 134 which are connected to the mounting section 182 and extend outward from a first edge of the mounting section 182. The mounting section 182 includes a plurality of mounting tabs 184 that are configured to be inserted into slots within the base 102 of the connector 100 to secure the plurality of ground contacts 132 within the connector 100 in a manner that will be described in greater detail below. Further, as shown in FIGS. 5A and 5B, the mounting section 182 includes a ground contact tab 186 that is positioned adjacent selected mounting tabs 184. As shown in FIG. 5B, the ground contact tab 186 can be bent outward from a plane defined by the mounting tabs 184. This allows the ground contact tab 186 to make electrical contact with selected signal contacts 130 in a manner that will be described below in reference to FIG. 7.

Referring more specifically to FIG. 5B, it will be appreciated that the insulation displacement ends 134 of the plurality of ground contacts 132 are formed so that adjacent insulation displacement ends 134 are displaced in a direction perpendicular to the plane defined by the mounting section 182 and the mounting tabs 184 of the plurality of ground contacts 132. In particular, the insulation displacement end 134 of the ground contacts are alternately displaced or staggered by a bent section 190 so that the insulation displacement ends 134 are spaced from the plane defined by the mounting section 182 and the mounting tabs 184.

This permits the insulation displacement ends 134 of the ground contacts 132 to be positioned in closer proximity to each other thereby allowing forty ground contacts 132 to be positioned in a single connector 100 having substantially the same form factor as connectors of the prior art. Hence, in this embodiment a single row of forty ground contacts 132 can be formed into a single uniform strip that is connected to the ground bus defined by the forty ground conductors in the ribbon cable 122. The positioning of the ground contacts 132 into the retainer 106 and the base member 102 of the connector 100 will be described in greater detail below in reference to FIGS. 7 and 9.

Figure 6B:
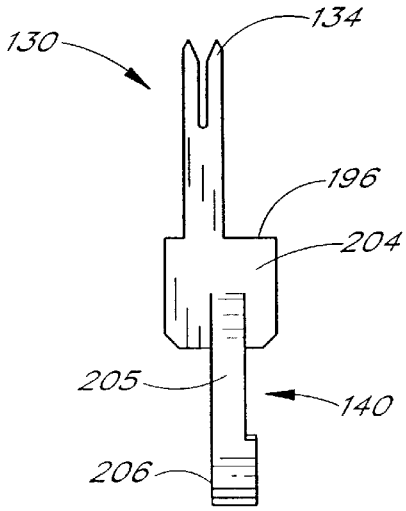
FIGS. 6A, 6B and 6C are isometric illustrations of the signal conductor contacts of the connector of FIG. 1.
Figure 6C:
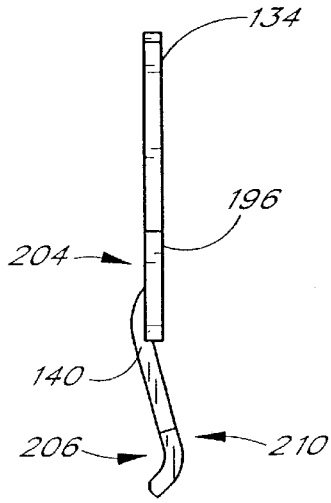
Figure 6A:
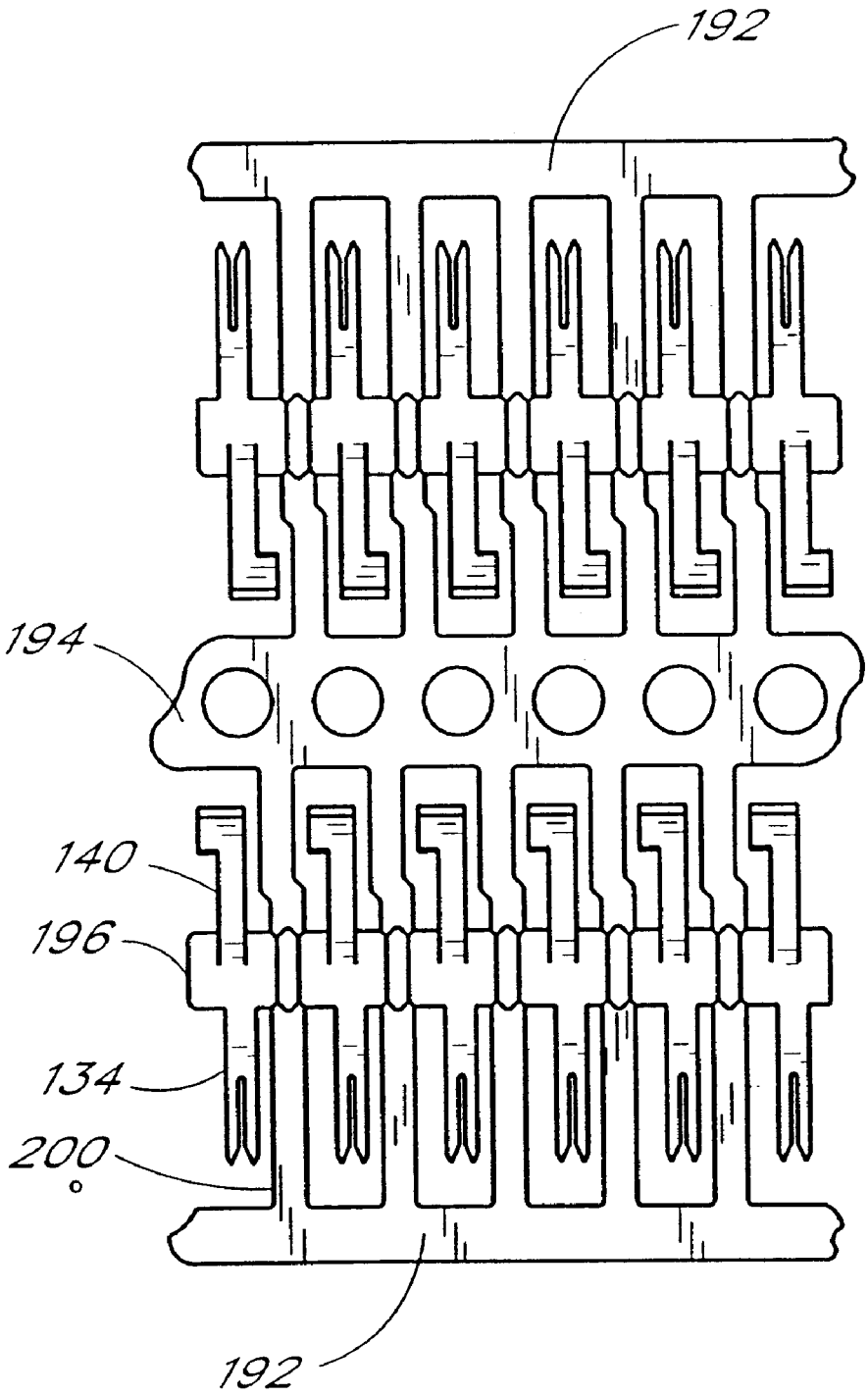

FIGS. 6A through 6C illustrate the preferred configuration of the signal contacts 130 of the preferred embodiment. Specifically, FIG. 6A illustrates that the signal contacts are initially formed within two carriers 192 and 194. The function of the carriers 192 and 194 is similar to the carrier 180 described in reference to the ground contacts 132 in that the carriers 192 and 194 hold the signal conductors 130 in a desired orientation prior to installation in the connector 100 and protect the signal contacts 130 from being deformed as a result of handling prior to installation. The signal contacts 130 include the insulation displacement end 134 and the mating end 140 with a mounting section 196 interposed therebetween.

The carrier 192 is attached to the mounting section 196 of the signal contact 130 via an arm 200 which is attached to a comer of two adjacent mounting sections 196 of two adjacent signal contacts 130. Similarly, the carrier 194 is attached to the mounting sections 196 of two adjacent signal contacts 130 via an arm 202 which is connected to the mounting section 196 in a location that is substantially adjacent the mating end 140 of the signal contact 130. The interface between the carrier arms 200 and 202 and the mounting section 196 is preferably scored or perforated so as to facilitate easy removal of the carriers 192 and 194 from the plurality of signal contacts 130 positioned in the carriers.

Referring to FIGS. 6B and 6C, the signal contact 130 includes an insulation displacement end 134, the function and configuration of which has been described above in reference to FIG. 1. The insulation displacement end 134 is preferably attached to the mounting section 196 so as to be co-planar with the mounting section 196. The mating end 140 of the signal contact 130 is attached to a first face 204 of the mounting section 196 of the signal contact 130. The mating end 140 includes an arm 205 that extends initially outward in a first direction from the first face 204 of the mounting section 196 and then is generally bent in a direction towards the plane defined by the mounting section 196 and is then terminated in a pin contact 206.

The arm 205 of the pin contact 206 is preferably attached to a curved contact face 210 that is positioned inward of the plane defined by the first face 204 of the signal contact 130. The curved contact face 210 is then bent outward so as to form the curved shape shown in FIG. 6C. Further, the contact face 210 has a cross-sectional area that is greater than the arm 205, as is shown in FIG. 6B.

Figure 8B:
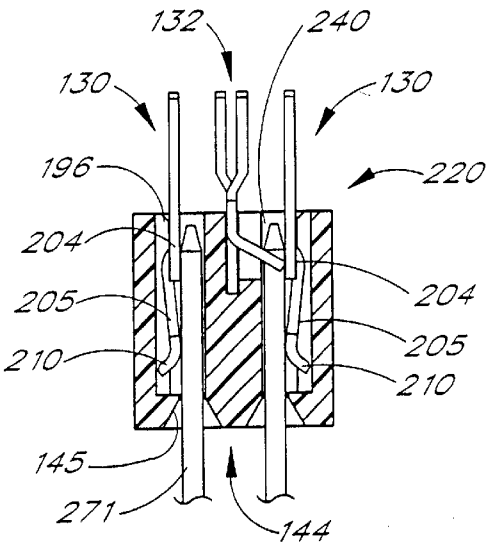
FIGS. 8A and 8B are sectional views of the base member of FIG. 7 illustrating the interconnection between the ground conductor contacts and selected signal conductor contacts.
Figure 8A:
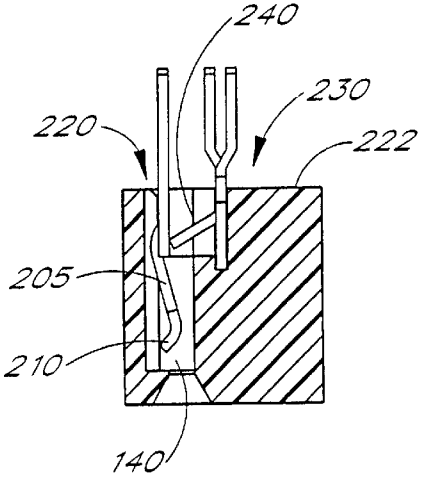

FIGS. 8A and 8B illustrate the positioning of the signal contact 130 in the base member 102 in greater detail. Specifically, the signal contact 130 is preferably mounted within the base member 102 of the connector 100 so that the contact face 210 is positioned within the openings 142 formed on the outer surface 166 of the base member 102. As shown in FIG. 8A, the curvature of the arm 205 results in the contact face 210 being biased so as to extend inwardly into the center of the opening 142. Consequently, insertion of another external pin contact 271 or mating connector into the opening 142 in the manner shown in FIG. 8B results in the external pin contact 271 making contact with the contact face 210 and displacing the contact face 210 away from the center of the opening 144. The curvature of the arm 205 and the contact face 210 thereby results in the contact face 210 being continuously urged against the external contact 271 that is positioned within the opening 142 and thereby facilitates electrical connection between the contact 130 and the external contact 271.

As shown in FIG. 8B, the opening 142 preferably has a recessed section 145, adjacent the outer surface 166 of the base member 102 that is configured to facilitate positioning of the external pin contact 271 in the opening 142. As is also shown in FIG. 8B, the external pin contact 271 also makes contact with the front face 204 of the mounting section 196 of the signal contact 130. It will be appreciated that the exact configuration of the mating end 140 of the signal contact 130 will vary depending upon the configuration of the external contact being inserted in the opening 144.

FIG. 7 illustrates the bottom side of the base 102 after the plurality of ground contacts 132 and the plurality of signal contacts 130 had been positioned within the base 102. Specifically, the base 102 incorporates a plurality of openings 220 on the bottom face 222 that are configured to receive the signal contacts 130. The plurality of openings 220 are preferably arranged in two parallel lines of twenty openings each. Each opening 220 is preferably dimensioned so that the mounting section 196 of the signal contacts 130 (FIG. 6B) is positioned adjacent the side walls of the opening 220 so that the friction between the side walls of the opening 220 and the mounting section 196 retains the signal contact 130 within the opening 220. The insulation displacement ends 134 thereby extend outward from the bottom surface or face 222 of the base 102 so as to be positioned within the openings 154 in the retainer 106 in the manner described above.

Further, FIG. 7 illustrates that the bottom face 222 of the base 102 includes an opening 230 which extends substantially the entire length of the bottom face 222 of the base 102. The opening 230 is configured to receive the mounting section 182 and, in particular, the mounting tabs 184, of the plurality of ground contacts 132. The width of the opening 230 is preferably selected so as to be approximate to the thickness of the mounting section 182 of the plurality of ground contacts 132 in the manner shown in FIGS. 8A and 8B. Hence the plurality of ground contacts 132 are retained within the base 102 of the connector 100 as a result of the frictional engagement between the mounting section 182 of the plurality of ground contacts 132 and the inner walls of the opening 230 in the base member 102. The insulation displacement ends 134 of the ground contacts 132 therefore extend outward from the bottom surface 222 of the base 102 of the connector 100 where the insulation displacement ends 134 are inserted into the openings 154 and the retainer 106.

As is discussed above, some of the signal conductors 124 within the ribbon cable 122 are grounded. It is desirable to connect these grounded signal conductors to the ground bus that is comprised of the forty grounded conductors within the ribbon cable 122 at each connection point to the ribbon cable. To accommodate this, one or more grooves or channels 240 are formed at selected locations in the bottom face 222 of the base 102 of the connector 100. As shown in FIGS. 7, 8A and 8B, each of the grooves 240 extend between the mounting section 196 of the signal contact 130 and the mounting section 182 of the ground contact 132 in a position that is located adjacent the bendable ground contact tab 186 (FIGS. 5A and 5B) of the ground contact 132. The grooves 240 are configured to accommodate the tabs 186 on the plurality of ground contacts 132 so that the tabs 186 can be bent into the grooves 240 so as to make contact with a back face 242 of selected signal contacts 130. The selected signal contacts 130 are the signal contacts 130 that are positioned to be connected to a grounded signal conductor 124 within the ribbon cable 122 when the connector 100 is connected to the ribbon cable 122.

As shown in FIG. 8A, the tab 186 is bent so as to be positioned within the groove 240 preferably prior to the insertion of the plurality of ground contacts 132 into the opening 230 (FIG. 7). Subsequently, the signal contacts 130 are inserted into the openings 220 and the selected signal contacts 130 that are inserted into the openings 220 that are adjacent the grooves 240. Consequently, the selected signal contacts 130 makes physical contact with the ground conductor tabs 186 that are positioned within the grooves 240. Consequently, each signal contact 130 that is physically touching a ground conductor tab 186 is therefore electrically connected to the ground bus comprised of the forty grounded conductors of the ribbon cable when the ground contacts 132 are connected to the ground conductors within the ribbon cable 122. Hence, interconnecting the grounded signal conductors in the ribbon cable to the ground bus at the connector 100 is simplified as the assembler of the connector 100 simply has to bend the tabs 186 on the plurality of ground contacts 132 so that they are positioned within the grooves 240 and then install the signal contacts 130.

Figure 9:
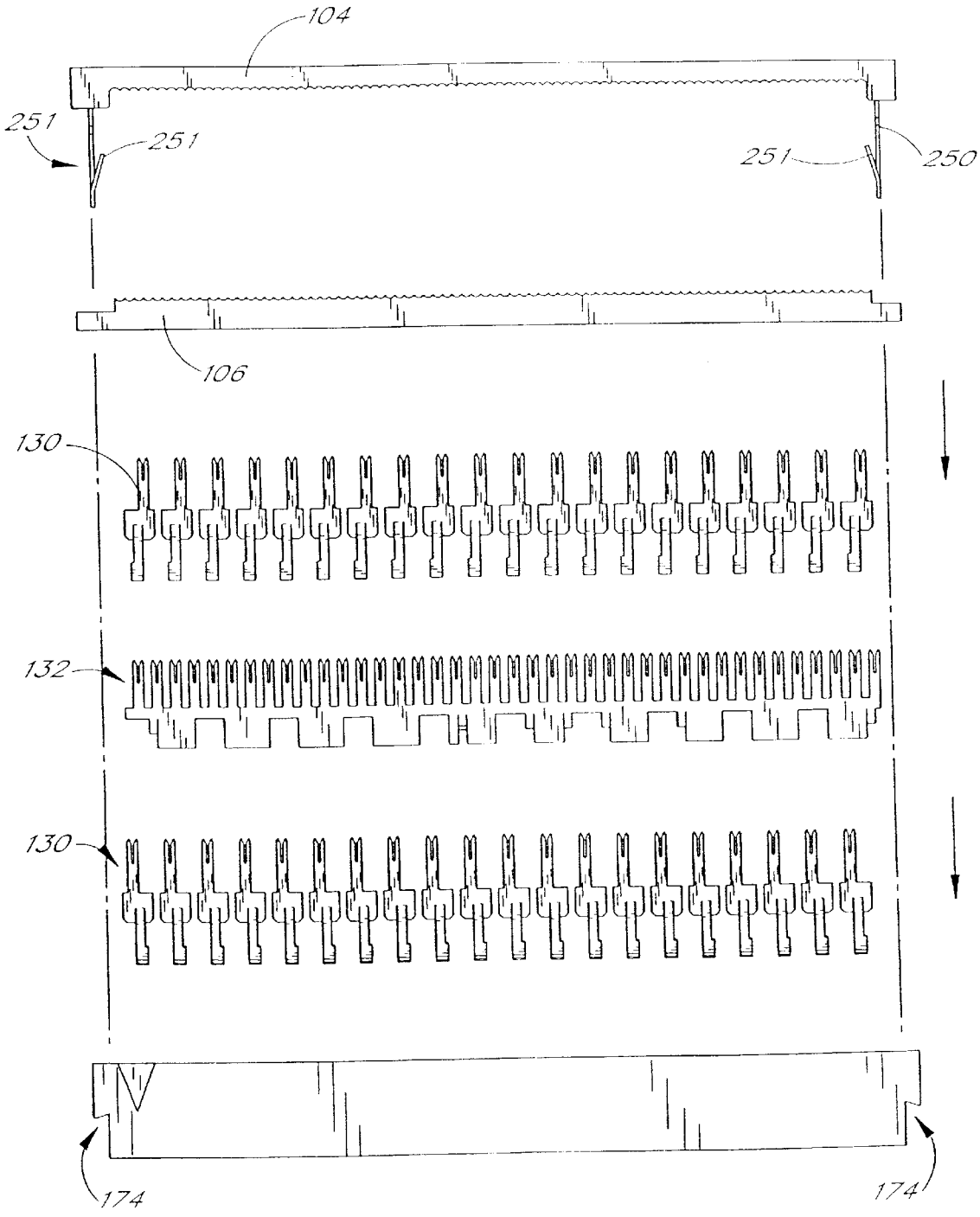
FIG. 9 is a partially exploded view of the connector of FIG. 1 used to describe the assembly of the connector of FIG. 1.

FIG. 9 is an exploded isometric view of the components comprising the connector 100 of the preferred embodiment. The assembly of the connector 100 is simplified by several advantageous features of the connector 100 of the preferred embodiment. In particular, referring initially to FIG. 5A, the ground contacts 132 are initially positioned in the openings 154 of the retainer 106. Specifically, the carrier 180 is grasped either by the assembler or by a machine controlled by the assembler and the insulation displacement ends 134 are located adjacent the two center rows of openings 154 until the plurality of insulation displacement ends are positioned adjacent the appropriate openings 154. The insulation displacement ends 134 of the plurality of ground contacts 132 are then pushed through the opening 154 in the retainer 106 and the openings 154 of the retainer 106 are preferably sized so as to be only slightly larger than the insulation displacement ends 134 of the ground contacts 132 so that the plurality of ground contacts 132 is retained by frictional forces in the retainer 106.

The carrier 180 is preferably perforated or scored at its attachment point to the mounting section 182 of the plurality of ground contacts 132 as is shown in FIG. 5A. Hence, the carrier 180 can then be removed from the plurality of ground contacts 132 once the insulation displacement ends 134 are adequately seated within the openings 154 and the retainer 106. Subsequently, the assembler can bend the tabs 186 so that they will be positioned within the grooves 240 in the base member 102 when the mounting tabs 184 of the plurality of ground contacts 132 are to be positioned within the opening 230 (FIG. 7) of the base member 102.

The assembler installs the signal contacts 130 initially into the base 102 in the following manner. The carrier 194 is removed from the signal contacts 130 so that the mating ends 140 are exposed. The mating ends 140 are then inserted into the openings 220 in the base 102 of the connector 100 so that the mounting section 196 is seated within the opening 220. Preferably, the assembler urges the mating ends 140 into the openings 220 by manipulation of the mating ends 140 via grasping the remaining carrier 192. Using the remaining carrier 192 to maneuver and manipulate the signal contacts 130 forming a single row of twenty signal contacts 130 minimizes the likelihood of inadvertently displacing or moving the insulation displacement ends 134 of the signal contacts 130 during installation.

Preferably, the signal contacts 130 are provided in twenty contact rows in the carriers 192 and 194. Hence, the assembler simply has to position two rows within the base 102 in the above described fashion. Subsequently, the assembler then removes the carrier 192 so that the insulation displacement ends 134 of the signal contacts 130 are exposed to allow the insulation displacement ends 134 of the signal contacts 130 to be positioned within the openings 154 in the retainer 106.

Once both rows of signal contacts 130 are positioned in the base 102, the retainer 106 containing the installed ground contacts 132 is then positioned adjacent the bottom surface 222 of the base 102. This permits the mounting tabs 184 of the ground contacts 132 (FIG. 8A) to be positioned adjacent the opening 230 of the base 102 of the connector 100. Similarly, the insulation displacement ends 134 of the signal contacts 130 are positioned adjacent the openings 154 in the retainer 106. The retainer is then positioned adjacent the inner surface 222 of the base 102 so that the mounting tabs 184 of the ground contacts 132 are positioned within the opening 230 and so that the insulation displacement ends 134 of the signal contacts 130 are inserted into the corresponding openings 154 in the retainer 106. It will be appreciated that the insertion of the mounting section 182 of the ground contacts 132 into the opening 230 will result in the ground conductor tabs 186 being positioned in the groove 240 (FIG. 7) so as to make electrical contact with the signal contacts 130 corresponding to the grounded signal conductors within the ribbon cable 122.

Subsequently, the ribbon cable 122 can be positioned in the cable receiving area 120 (FIG. 1) so that the ridges 121 of the ribbon cable are positioned within the corresponding indentations 112 of the cover 104 and the indentations 116 of the inner surface of the retainer 106. When the cover 104 is positioned adjacent the surface of the retainer 106, the conductors 124 are preferably centered inside of the conductor spaces 126. As the openings 154 and the retainer 106 are specifically positioned so that the insulation displacement ends 134 of the appropriate contacts 130, 132 are centered about the conductor receiving spaces 126, positioning the cover 104 adjacent the retainer 106 with the ribbon cable 122 positioned therebetween will result in the insulation displacement ends 134 of the contacts 130, 132 piercing the insulation surrounding the conductor so as to make electrical contact with the appropriate conductors 124 positioned within the ribbon cable 122.

It will be appreciated that the compression between the cover 104 and the retainer 106 helps to exactly center the conductors 124 within the ribbon cable in the conductor spaces 126. In particular, in the ribbon cable 120, each conductor 124 is spaced 0.025 inches apart with a typical tolerance of 0.006 inches. The compression between the cover 104 and the retainer 106 results in the vinyl material between adjacent conductors 124 contracting or stretching so that the contoured vinyl surface surrounding each conductor is centered in the conductor spaces 126. This results in the conductors 124 being centered in the space 126 so that the insulation displacement ends can make contact with the appropriate conductors 124.

FIG. 9 illustrates that there are two clip devices 250 which are mounted in the openings 150 on the cover 104 and extend through the openings 164 on the retainer 106 and into the grooves 170 on the base 102. The clip device 250 has a rearwardly disposed blade 251 which makes contact with the angled surface 174 of the base 102 so as to securely retain the cover 104 in flush proximity to the retainer 106 and the base 102 of the connector 100. It will be appreciated that any of a number of connection devices can be used to couple the connector 100 together and retain the connector on the ribbon cable.

Preferably, the signal and ground contacts are premounted in the base 102 and retainer 106 prior to installing the connector 100 on the ribbon cable 122. Subsequently, the installer simply has to position the cable 122 in the indentations 112 and then position the cover 104 adjacent the retainer 106 and the indentations 112 and 116 will center the conductors 124 within the spaces 126. The insulation displacement ends 134 then are guided via the openings 154 in the retainer 106 into the correct conductor 124 of the ribbon cable 122. Hence, installation of the connector 100 onto the ribbon cable is greatly simplified over prior art ribbon cable connectors.

From the foregoing, it will be appreciated that the connector 100 of the preferred embodiment is configured to have a plurality of ground contacts that will make electrical contact with ground conductors that comprise a ground bus within a ribbon cable. In the embodiment described, the ground contacts are located so as to be able to contact every other conductor in an eighty conductor ribbon cable. The ground contacts are positioned within the same connector body that is configured to also have forty signal contacts that are positioned so as to make contact with signal conductors within the ribbon cable. Hence, the connector of the preferred embodiment allows for connection to both signal conductors and ground conductors in a ribbon cable all within the same connector thereby eliminating the need for a separate connector for the conductors comprising the ground bus of a ribbon cable.

Moreover, the preferred embodiment of the connector 100 is configured to be connected to a ribbon cable that has a plurality of ground conductors that comprise a ground bus while having dimensions and a form factor that are substantially the same as the dimensions and form factor of connectors used to make connection to ribbon cable not having a ground bus. In particular, the preferred embodiment of the present invention has described a conductor that is capable of being connected to ribbon cable corresponding to the SFF-8049 specification while being dimensioned so as to have a form factor substantially the same as the form factor for prior art connectors configured to be attached to ribbon cable corresponding to the ANSIx3.279-1996 specification.

Further, the connector of the preferred embodiment allows for simple interconnection between grounded signal conductors and ground conductors at the connector. In particular, the ground contacts are configured to be selectively engagable with the signal contacts that are to contact the grounded signal conductors. Hence, interconnecting the grounded signal conductors to the ground bus at each connector is simplified when using the connector of the preferred embodiment.

Still further, the assembly of the preferred embodiment of the connector is simplified in that the ground contacts are arranged to have a plurality of insulation displacement ends that are otherwise connected in a single row so that each of the ground contacts can be mounted at one time as they are preferably one continuous piece. The signal contacts are initially held together by carriers which allow for a plurality of adjacent signal contacts to be positioned within the base of the connector at one time thereby eliminating the need to individually position signal contact within the connector or connector housing. Hence, assembly of the connector of the preferred embodiment is simplified over the assembly of similar connectors of the prior art.

Although the preferred embodiment of the present invention has shown, described and pointed out the fundamental novel features of the invention as applied to these embodiments, it will be understood the various omissions, substitutions, and changes in the form of the detail of the device illustrated may be made by those skilled in the art without departing from the spirit of the present invention. For example, the base 102 of the device 100 is described as being configured to receive a plurality of pin contacts through a plurality of openings. The base 102 may be configured to receive a well known socket or plug type connection. Further, while the preferred embodiment has been described in reference to ribbon cable corresponding to the SFF-8049 specification with eighty conductors spaced apart on 0.025 inch centers, the connector of the present invention can be adapted to other ribbon cables without departing from the spirit of the present invention. Consequently, the scope of the invention should not be limited to the foregoing description but is to be defined by the appended claims.

What is claimed is:

1. A connector for a multi-conductor ribbon cable that has a plurality of conductors, the connector comprising:

a plurality of ground contacts that have a first end which is configured to be electrically connected to ground conductors within the ribbon cable;

a plurality of signal contacts that have a first end which is configured to be electrically connected to signal conductors within the ribbon cable, wherein the plurality of signal contacts include a second end that provides a contact point for external contacts to make electrical contact with the plurality of signal conductors in the ribbon cable via the plurality of signal contacts and wherein a selected set of the plurality of signal contacts comprise contacts that are configured to be electrically connected to signal conductors that are grounded;

a base member having a first surface and wherein at least one opening is formed in the first surface so as to receive the plurality of ground contacts and a second plurality of openings is formed in the first surface so as to receive the plurality of signal contacts wherein the at least one opening and second plurality of openings are positioned in the first surface so as to retain the plurality of ground contacts and the plurality of signal contacts in a fixed relationship relative to each other with the first ends of the plurality of signal contacts and the first ends of the plurality of ground contacts extending outward from the first surface; and a cover member that is detachably engaged with the base member wherein the cover member defines a ribbon cable receiving area and is configured so that, when the cover member is engaged with the base member and the ribbon cable is positioned in the ribbon cable receiving area, the conductors of the ribbon cable are positioned adjacent the openings in the first surface of the base member so that the first ends of the plurality of ground contacts make electrical contact with ground conductors within the ribbon cable and the first ends of the plurality of signal contacts make electrical contact with the plurality of signal conductors within the ribbon cable and wherein at least one of the ground contacts is electrically coupled to the grounded signal conductor.

2. The connector of claim 1, wherein the base member includes a plurality of openings formed in a second surface of the base member that provide access to the second ends of the plurality of signal contacts positioned in the base member.

3. The connector of claim 1, wherein the plurality of ground contacts is comprised of a single mounting section with a plurality of insulation displacement ends extending outward from a first edge of the single mounting section.

4. The connector of claim 3, wherein the at least one opening in the first surface of the base member is comprised of a single opening which extends in a first direction across the first surface of the base member, wherein the first direction is in a direction that is transverse to the ribbon cable when the ribbon cable is positioned within the ribbon cable receiving area.

5. The connector of claim 4, wherein the plurality of insulation displacement ends are attached to the first edge of the single mounting section so that alternating insulation displacement ends are spaced in a second direction, perpendicular to the first direction, from each other.

6. The connector of claim 5, wherein the plurality of insulation displacement ends is comprised of forty displacement ends that are centered approximately 0.050 inches apart from each other in the first direction and are positioned in the base member so as to be able to make electrical contact with every other conductor within the ribbon cable that corresponds to the SFF-8049 specification.

7. The connector of claim 6, wherein at least one of the signal conductors within the ribbon cable is a grounded signal conductor and wherein at least one groove is formed in the first surface of the base member between the ground contact opening and the signal contact opening corresponding to the grounded signal contact.

8. The connector of claim 7, wherein the mounting section of the plurality of ground contacts include a bendable tab that can be positioned within the groove so as to make an electrical connection between the signal contact corresponding to the grounded signal conductor and the plurality of ground contacts.

9. The connector of claim 1, wherein the plurality of openings in the first surface of the base member are positioned within the first surface so as to receive two rows of signal contacts.

10. The connector of claim 9, wherein the plurality of openings of the base member are positioned in the first surface so that there are two rows of twenty openings each that are spaced so as to retain the signal contacts in each row are centered approximately 0.10 inches from each other and each row is staggered so that the first ends of the plurality of signal contacts make electrical contact with every other signal conductor within a specification SFF-8049 ribbon cable.

11. The connector of claim 1, wherein the first ends of the plurality of ground conductors and the first ends of the plurality of signal conductors are insulation displacement ends that are configured to displace the insulation surrounding the conductors within the ribbon cable and make electrical contact thereto.

12. The connector of claim 11, wherein the insulation displacement ends of the plurality of ground contacts and the plurality of signal contacts are comprised of a neck portion that is mounted to a mounting section of the plurality of ground contacts or the plurality of signal contacts and two blades which define a space therebetween and wherein the conductor within the ribbon cable is preferably positioned in the space when the insulation displacement end is positioned within the ribbon cable to make electrical contact between the contacts of the connector and the ribbon cable.

13. The connector of claim 12, further comprising a retainer that is to be positioned between the base member and the cover adjacent the first surface of the base member, wherein the retainer includes a plurality of openings that extend therethrough so as to receive the insulation displacement ends of both the plurality of ground contacts and the plurality of signal contacts are positioned within the opening and wherein a second surface of the retainer is positioned adjacent an inner surface of the cover defining the cable receiving area so that the ribbon cable is positioned between the inner surface of the cover and the second surface of the retainer when positioned in the connector.

14. The connector of claim 13, wherein both the inner surface of the cover and the second surface of the retainer has a plurality of indentations formed therein that are configured to receive the contours of the insulation surrounding each conductor within the ribbon cable and wherein the indentations are configured so as to center the conductor within a space defined by both the indentations on the cover and the retainer when the cover is positioned adjacent the retainer to thereby facilitate electrical connection between the insulation displacement ends of the plurality of ground contacts and the plurality of signals contacts and the conductors within the ribbon cable.

15. The connector of claim 14, wherein a plurality of openings are formed in the inner surface of the cover and are spaced and configured to receive the outer edges of the blades of the insulation displacement ends of the plurality of signal contacts and the plurality of ground contacts and retain these outer edges of the blades in isolation from adjacent blades.

* * * * *